US010017350B2

(12) United States Patent
Ando et al.

(10) Patent No.: US 10,017,350 B2
(45) Date of Patent: Jul. 10, 2018

(54) SHEET PROCESSING APPARATUS THAT PROPERLY PERFORMS FOLD LINE PROCESSING, AND IMAGE FORMING SYSTEM

(71) Applicant: CANON KABUSHIKI KAISHA, Tokyo (JP)

(72) Inventors: Yutaka Ando, Toride (JP); Akinobu Nishikata, Abiko (JP); Akihiro Arai, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 156 days.

(21) Appl. No.: 14/938,344

(22) Filed: Nov. 11, 2015

(65) Prior Publication Data

US 2016/0137453 A1 May 19, 2016

(30) Foreign Application Priority Data

Nov. 19, 2014 (JP) ..... 2014-234560

(51) Int. Cl.

| | |
|---|---|
| ***B65H 1/00*** | (2006.01) |
| ***B65H 37/06*** | (2006.01) |
| ***B31F 1/00*** | (2006.01) |
| ***B65H 45/12*** | (2006.01) |
| ***B65H 37/04*** | (2006.01) |

(Continued)

(52) U.S. Cl.

CPC ..... *B65H 37/06* (2013.01); *B31F 1/00* (2013.01); *B31F 1/0006* (2013.01); *B31F 1/0035* (2013.01); *B65H 37/04* (2013.01); *B65H 45/12* (2013.01); *B65H 45/18* (2013.01); *G03G 15/6538* (2013.01); *G03G 15/6541* (2013.01); *B65H 2301/163* (2013.01); *B65H 2301/51232* (2013.01); *B65H 2408/125* (2013.01); *B65H 2511/10* (2013.01); *B65H 2511/22* (2013.01); *B65H 2515/112* (2013.01); *B65H 2701/13212* (2013.01); *B65H 2801/06* (2013.01);

(Continued)

(58) Field of Classification Search

CPC ..... B31F 1/00; B31F 1/0006; B31F 1/0035; B65H 45/12; G03G 2215/00877

USPC ..... 270/32, 45, 58.07

See application file for complete search history.

(56) References Cited

U.S. PATENT DOCUMENTS 7,147,598 B2 * 12/2006 Fujimoto ..... B65H 29/12 270/45

7,431,274 B2 10/2008 Kushida et al.

(Continued)

*Primary Examiner* — Leslie A Nicholson, III

(74) *Attorney, Agent, or Firm* — Rossi, Kimms & McDowell LLP

(57) ABSTRACT

A sheet processing apparatus that is capable of properly performing fold line processing at a position depending on a sheet bundle. In a sheet processing apparatus, sheets sequentially received from an image forming apparatus are stacked on a bookbinding processing tray to form a sheet bundle. The sheet bundle is folded at the center thereof, and is conveyed to a processing position. A press unit moves along a fold line portion of the sheet bundle to thereby perform flattening processing for flattening the fold line portion by pressing the fold line portion from a direction orthogonal to a thickness direction. A first pressing strength set by a user using the image forming apparatus and the second pressing strength acquired information on the sheet bundle are compared with each other, and the processing position is determined based on a result of the comparison.

10 Claims, 14 Drawing Sheets

J1

| |
|---|
| BUNDLE ID |
| NUMBER OF SHEETS OF A BUNDLE |
| SHEET WIDTH [mm] |
| SHEET LENGTH [mm] |
| BASIS WEIGHT [gsm] |
| SHEET TYPE |
| SADDLE PRESS |
| PRESSURE ADJUSTMENT VALUE [pls] |
| PRESSURE ADJUSTMENT DISTANCE L [mm] |

(51) Int. Cl.
*B65H 45/18* (2006.01)
*G03G 15/00* (2006.01)

(52) U.S. Cl.
CPC ..... *B65H 2801/27* (2013.01); *G03G 2215/00877* (2013.01)

(56) References Cited

U.S. PATENT DOCUMENTS 8,201,815 B2 * 6/2012 Sasahara ..... B65H 45/18 270/32
8,220,791 B2 * 7/2012 Suzuki ..... B65H 45/18 270/32
8,439,341 B2 * 5/2013 Ishikawa ..... B65H 45/18 270/45

* cited by examiner

*FIG. 10*

J1

| |
|---|
| BUNDLE ID |
| NUMBER OF SHEETS OF A BUNDLE |
| SHEET WIDTH [mm] |
| SHEET LENGTH [mm] |
| BASIS WEIGHT [gsm] |
| SHEET TYPE |
| SADDLE PRESS |
| PRESSURE ADJUSTMENT VALUE [pls] |
| PRESSURE ADJUSTMENT DISTANCE L [mm] |

*FIG. 13*

T1

| | | NUMBER OF SHEETS OF A BUNDLE | | | | | | | | | | | | | | | |
|---|---|---|---|---|---|---|---|---|---|---|---|---|---|---|---|---|---|
| | | 1-10 | 11 | 12 | 13 | 14 | 15 | 16 | 17 | 18 | 19 | 20 | 21 | 22 | 23 | 24 | 25 |
| BASIS WEIGHT (PLAIN PAPER) | 64-79 | 10 | 10 | 10 | 10 | 10 | 10 | 10 | 9 | 9 | 8 | 8 | 7 | 7 | 6 | 6 | 5 |
| | 80-105 | 10 | 10 | 10 | 10 | 10 | 10 | 10 | 9 | 9 | 8 | 8 | 7 | 7 | 6 | 6 | 5 |
| | 106-128 | 10 | 10 | 10 | 10 | 9 | 9 | 8 | 8 | 7 | 6 | 6 | 5 | 5 | 5 | 5 | 5 |
| | 129-216 | 8 | 7 | 6 | 5 | 5 | 5 | 5 | 5 | 5 | 5 | 5 | 5 | 5 | 5 | 5 | 5 |
| | 217-325 | 7 | 6 | 5 | 5 | 5 | 5 | 5 | 5 | 5 | 5 | 5 | 5 | 5 | 5 | 5 | 5 |
| BASIS WEIGHT (COATED PAPER) | 64-79 | 10 | 10 | 10 | 9 | 9 | 8 | 8 | 7 | 7 | 6 | 6 | 5 | 5 | 4 | 4 | 3 |
| | 80-105 | 10 | 10 | 10 | 9 | 9 | 8 | 8 | 7 | 7 | 6 | 6 | 5 | 5 | 4 | 4 | 3 |
| | 106-128 | 9 | 9 | 8 | 8 | 7 | 7 | 6 | 6 | 5 | 4 | 4 | 3 | 3 | 3 | 3 | 3 |
| | 129-216 | 6 | 5 | 4 | 3 | 3 | 3 | 3 | 3 | 3 | 3 | 3 | 3 | 3 | 3 | 3 | 3 |
| | 217-325 | 5 | 4 | 3 | 3 | 3 | 3 | 3 | 3 | 3 | 3 | 3 | 3 | 3 | 3 | 3 | 3 |

SHEET PROCESSING APPARATUS THAT PROPERLY PERFORMS FOLD LINE PROCESSING, AND IMAGE FORMING SYSTEM

BACKGROUND OF THE INVENTION

Field of the Invention

The present invention relates to a sheet processing apparatus that performs post processing on sheets having images formed thereon, and an image forming system including the sheet processing apparatus.

Description of the Related Art

Conventionally, there has been widely known a sheet processing apparatus, such as a copy machine or a printer, that is disposed downstream of an image forming apparatus, and performs post processing, such as stitching, on sheets output from the image forming apparatus. In recent years, sheet processing apparatuses have come to be equipped with more functions, and there has been proposed sheet processing apparatuses capable of performing not only conventional side stitching, but also saddle stitching. Further, the sheet processing apparatuses capable of performing saddle stitching include those which are further equipped with a bookbinding function for folding a stitched sheet bundle at a saddle-stitched portion to thereby form the sheet bundle into a booklet.

Further, there has been known a press processing technique in which a sheet bundle formed by a plurality of sheets stacked on a sheet stacking tray is conveyed while being folded, and a pressing roller is moved while pressing a fold line portion of the sheet bundle in a direction orthogonal to a conveying direction (thickness direction) to thereby improve the fold properties of the fold line portion. Further, U.S. Pat. No. 7,431,274 describes a technique in which in parallel with the press processing for pressing the fold line portion of the sheet bundle from opposite sides in a direction perpendicular to the sheet surface of the sheet bundle, there is performed flattening processing for flattening the fold line portion of the sheet bundle by pressing the fold line portion in a direction orthogonal to the thickness direction of the sheet bundle (direction opposite to the sheet conveying direction) using a shaping roller. A unit including the folding rollers (pressing rollers) and the shaping roller moves along the fold line portion, whereby it is possible to perform press processing and flattening processing in parallel, and make the fold line portion square-cornered, which further improves the fold properties.

An amount of pressure (pressing strength) applied to a fold line portion in flattening processing is determined according to a stop position, i.e. a processing position of a sheet bundle when the fold line portion of the sheet bundle is pressed. The amount of pressure can be set by a user as desired. However, when the set amount of pressure is large and also the sheet bundle has a large thickness, an operation load applied to the unit is sometimes larger than a driving force from a motor for moving the unit. In this case, the unit is incapable of moving along the fold line portion, which not only makes it impossible to properly perform the processing, but also brings about a possibility of erroneous detection of a failure of the unit in spite of the fact the unit is not in failure.

SUMMARY OF THE INVENTION

The present invention provides a sheet processing apparatus that is capable of properly performing fold line processing at a position depending on a sheet bundle, and an image forming system including the sheet processing apparatus.

In a first aspect of the present invention, there is provided a sheet processing apparatus comprising a stacking unit configured to have sheets stacked thereon which are sequentially received from an image forming apparatus, as a sheet bundle, a folding unit configured to fold the sheet bundle stacked on the stacking unit at the center of the sheet bundle in a conveying direction of the sheets, a conveying unit configured to convey the sheet bundle folded at the center by the folding unit to a processing position, a processing unit configured to move along a fold line portion of the sheet bundle conveyed to the processing position by the conveying unit, while pressing the fold line portion from a direction orthogonal to a thickness direction of the sheet bundle, to thereby perform flattening processing for flattening the fold line portion, a first acquisition unit configured to acquire a first pressing strength designated in the image forming apparatus as a pressing strength to be applied at a time of execution of the flattening processing, a second acquisition unit configured to acquire information on the sheet bundle to be processed by the processing unit, and acquire a second pressing strength from the acquired information, and a determination unit configured to determine the processing position based on the first pressing strength acquired by the first acquisition unit and the second pressing strength acquired by the second acquisition unit before the flattening processing is executed by the processing unit.

In a second aspect of the present invention, there is provided an image forming system comprising a sheet processing apparatus, and an image forming apparatus configured to communicably connect to the sheet processing apparatus, and discharge a sheet having an image formed thereon to the sheet processing apparatus, wherein the sheet processing apparatus includes a stacking unit configured to have sheets stacked thereon which are sequentially received from the image forming apparatus, as a sheet bundle, a folding unit configured to fold the sheet bundle stacked on the stacking unit at the center of the sheet bundle in a conveying direction of the sheets, a conveying unit configured to convey the sheet bundle folded at the center by the folding unit to a processing position, a processing unit configured to move along a fold line portion of the sheet bundle conveyed to the processing position by the conveying unit, while pressing the fold line portion from a direction orthogonal to a thickness direction of the sheet bundle, to thereby perform flattening processing for flattening the fold line portion, a first acquisition unit configured to acquire a first pressing strength designated in the image forming apparatus as a pressing strength to be applied at a time of execution of the flattening processing, a second acquisition unit configured to acquire information on the sheet bundle to be processed by the processing unit, and acquire a second pressing strength from the acquired information, and a determination unit configured to determine the processing position based on the first pressing strength acquired by the first acquisition unit and the second pressing strength acquired by the second acquisition unit before the flattening processing is executed by the processing unit.

According to the present invention, it is possible to properly perform fold line processing at a position depending on a sheet bundle.

Further features of the present invention will become apparent from the following description of exemplary embodiments (with reference to the attached drawings).

BRIEF DESCRIPTION OF THE DRAWINGS

FIG. 10 is a diagram showing a format of sheet bundle information.

FIG. 13 is a diagram showing an example of a table for use in setting an upper limit pressure adjustment value.

DESCRIPTION OF THE EMBODIMENTS

The present invention will now be described in detail below with reference to the accompanying drawings showing embodiments thereof.

Figure 1:
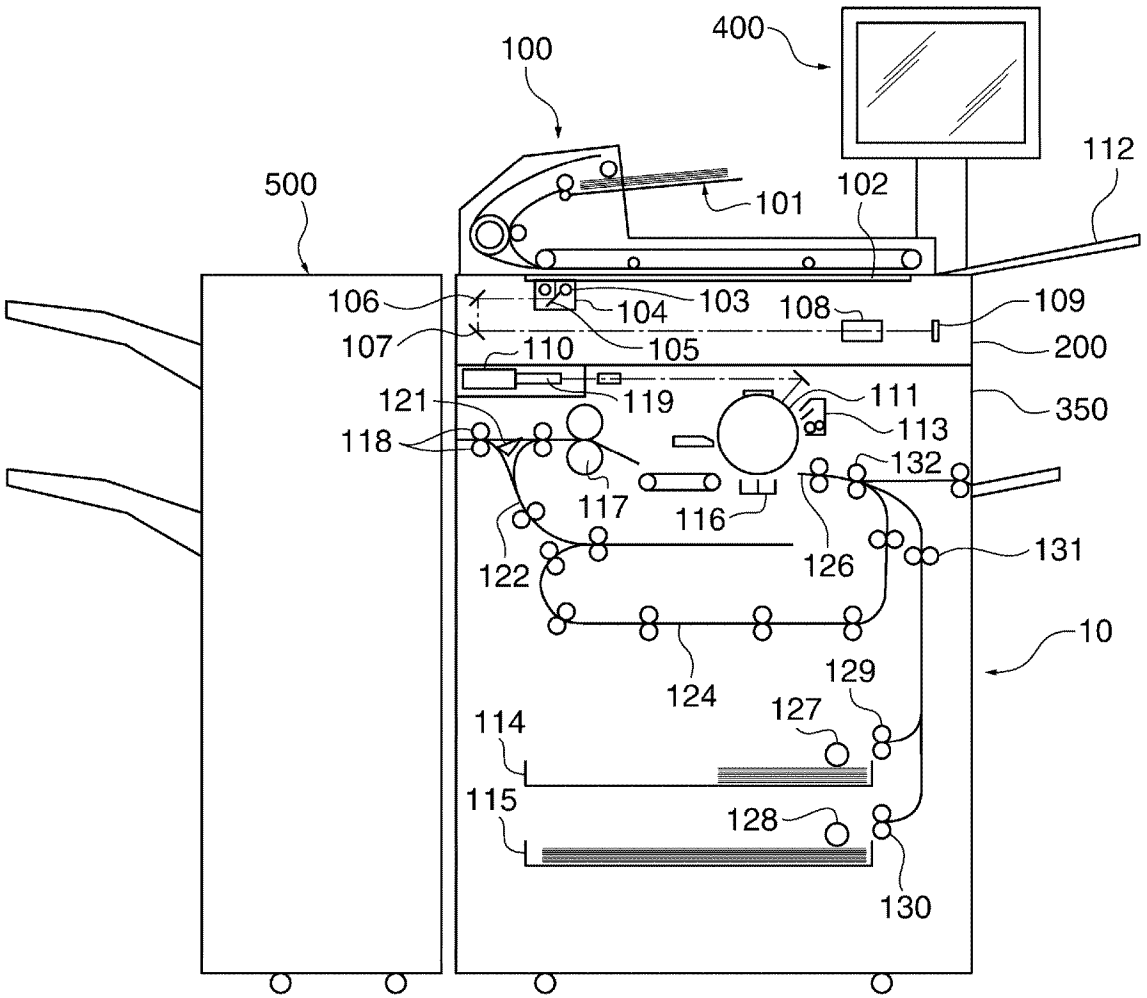
FIG. 1 is a schematic longitudinal cross-sectional view of an image forming system including a sheet processing apparatus according to an embodiment of the invention.

FIG. 1 is a schematic longitudinal cross-sectional view of an image forming system including a sheet processing apparatus according to an embodiment of the invention. The image forming system is comprised of an image forming apparatus 10 and a finisher 500 as the sheet processing apparatus connected to a downstream side of the image forming apparatus 10.

The image forming apparatus 10 is comprised of an image reader 200 for reading an image from an original, a printer 350 for forming the image read from the original on a sheet, and a console unit 400.

A document feeder 100 of the image reader 200 sequentially feeds originals which are set on a document tray 101 with their image surfaces facing upward, starting from the leading page, one by one, in the left direction as viewed in FIG. 1, such that each original is conveyed via a curved path through a predetermined reading position on a platen glass 102, from left to right, and is then discharged onto a discharge tray 112.

As each original passes the reading position from left to right on the platen glass 102, an image of the original is read by a scanner unit 104 held in a position corresponding to the reading position. Specifically, as the original passes the reading position, the image surface of the original is irradiated with light from a lamp 103 of the scanner unit 104, and reflected light from the original is guided to a lens 108 via mirrors 105, 106, and 107. Then, light having passed through the lens 108 forms an image on an imaging surface of an image sensor 109. The optically read image is converted to image data by the image sensor 109 and is output therefrom. The image data output from the image sensor 109 is input as a video signal to an exposure section 110 of the printer 350.

The exposure section 110 of the printer 350 modulates a laser beam based on the video signal input from the image reader 200 and outputs the modulated laser beam. The output laser beam is irradiated onto a photosensitive drum 111 while being scanned by a polygon mirror 119. On the photosensitive drum 111, an electrostatic latent image is formed according to the scanned laser beam. The electrostatic latent image formed on the photosensitive drum 111 is visualized as a developer image (toner image) by developer supplied from a developing device 113.

On the other hand, a sheet fed from an upper cassette 114 or a lower cassette 115 in the printer 350 via a pickup roller 127 or 128 is conveyed to a registration roller pair 126 by a sheet feed roller pair 129 or 130 and sheet feed rollers 131 and 132. When the leading end of the sheet reaches the registration roller pair 126, sheet information J1 (see FIG. 2) of the sheet is notified to an apparatus connected to the downstream side of the image forming apparatus 10 (the finisher 500 in the present example) via a communication IC, not shown.

Figure 2:
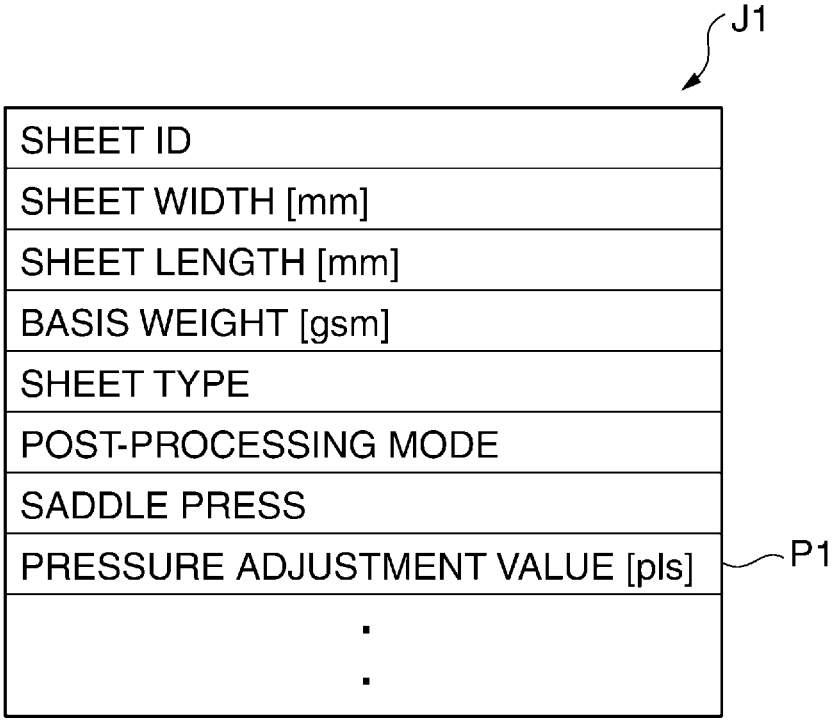
FIG. 2 is a diagram showing a format of sheet information.

Here, the sheet information J1 will be described. FIG. 2 is a diagram showing a format of the sheet information J1 transmitted from the image forming apparatus 10 to the finisher 500. The sheet information J1 includes a sheet ID for identifying each sheet, a sheet size (width and length of the sheet), a basis weight, a sheet material type, a designated post-processing mode, saddle press (SET or NOT SET), a pressure adjustment value, and so forth.

The image forming apparatus 10 drives the registration roller pair 126 in a desired timing to convey the sheet in between the photosensitive drum 111 and a transfer section 116. The developer image formed on the photosensitive drum 111 is transferred onto the fed sheet by the transfer section 116. The sheet having the developer image transferred thereon is conveyed to a fixing section 117. The fixing section 117 fixes the developer image on the sheet by heating and pressing the sheet. The sheet having passed the fixing section 117 passes a flapper 121 and a discharge roller pair 118, and is then discharged from the printer 350 into an external apparatus (the finisher 500 in the present example).

In a case where the image forming apparatus 10 discharges the sheet with an image-formed surface thereof facing downward (face down), the sheet having passed the fixing section 117 is temporarily guided into an inversion path 122 by switching operation of the flapper 121. Then, after the trailing edge of the sheet has passed the flapper 121, the image forming apparatus 10 switches back the sheet and discharges the same from the printer 350 by the discharge roller pair 118.

Further, when a double-sided printing mode for forming images on both sides of a sheet is set, after the sheet is guided into the inversion path 122 by switching operation of the flapper 121, the sheet is conveyed to a double-sided conveying path 124. Then, the sheet is caused to be fed in again between the photosensitive drum 111 and the transfer section 116 in the aforementioned timing.

The sheet discharged from the printer 350 of the image forming apparatus 10 is sent to the finisher 500. The arrangement of the finisher 500 and the control of sheets sequentially received from the image forming apparatus 10 by the finisher 500 will be described hereafter.

Figure 3:
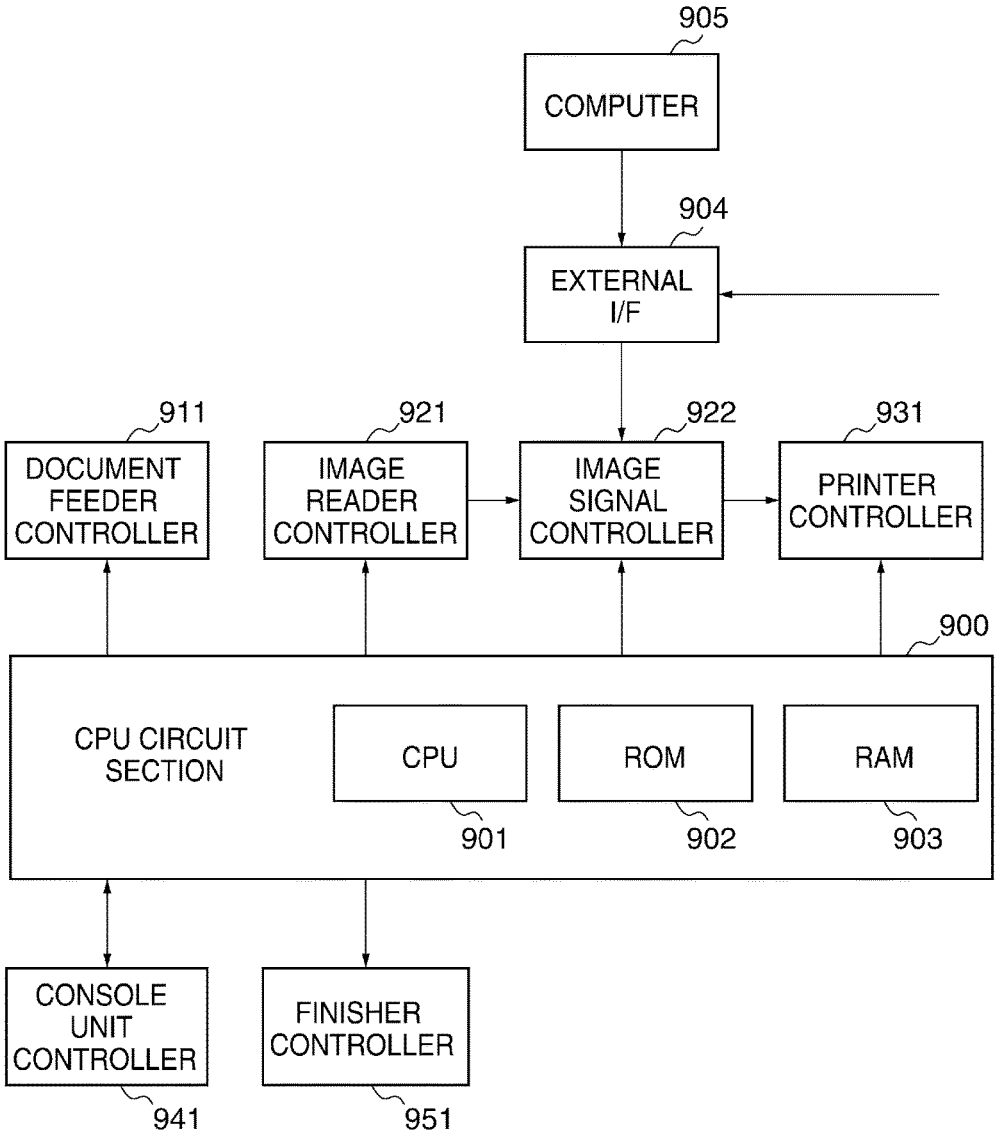
FIG. 3 is a schematic block diagram of a controller.

Next, a description will be given, with reference to FIG. 3, of the arrangement of a controller as a control section for controlling the overall operation of the image forming system shown in FIG. 1. FIG. 3 is a schematic block diagram of the controller.

As shown in FIG. 3, the controller has a CPU circuit section 900, and the CPU circuit section 900 incorporates a CPU 901, a ROM 902, and a RAM 903. The CPU 901 performs basic control of the overall operation of the image forming system, and controls controllers 911, 921, 922, 931, 941, and 951, in a centralized manner by executing control programs stored in the ROM 902. The RAM 903 temporarily stores control data, and is also used as a work area for executing arithmetic operations required for the control operation of the CPU 901.

The document feeder controller 911 drivingly controls the document feeder 100 according to instructions from the CPU circuit section 900. The image reader controller 921 drivingly controls the scanner unit 104, the image sensor 109, and so forth, and transfers an image signal output from the image sensor 109 to the image signal controller 922.

The image signal controller 922 converts the analog image signal from the image sensor 109 to a digital signal, then performs various kinds of processing on the digital signal, converts the processed digital signal to a video signal, and delivers the video signal to the printer controller 931. Further, the image signal controller 922 performs various kinds of processing on a digital image signal input from a computer 905 via an external interface 904, converts the processed digital image signal to a video signal, and delivers the video signal to the printer controller 931. The processing operations performed by the image signal controller 922 are controlled by the CPU circuit section 900. The printer controller 931 performs an image forming operation and sheet conveyance by controlling the exposure section 110 and the printer 350 based on the input video signal.

The image forming apparatus 10 and the finisher 500 are communicably connected to each other. The finisher control controller 951 is incorporated in the finisher 500, and exchanges information with the CPU circuit section 900 to thereby control the overall operation of the finisher 500.

The console unit controller 941 controls exchange of information between the console unit 400 and the CPU circuit section 900. The console unit 400 includes a plurality of keys for configuring various functions for image formation, and a display section 420 for displaying information indicative of the configurations. The console unit 400 outputs key signals corresponding to respective operations of keys to the CPU circuit section 900, and displays corresponding pieces of information on the display section 420 of the console unit 400 based on signals from the CPU circuit section 900.

Figure 4:
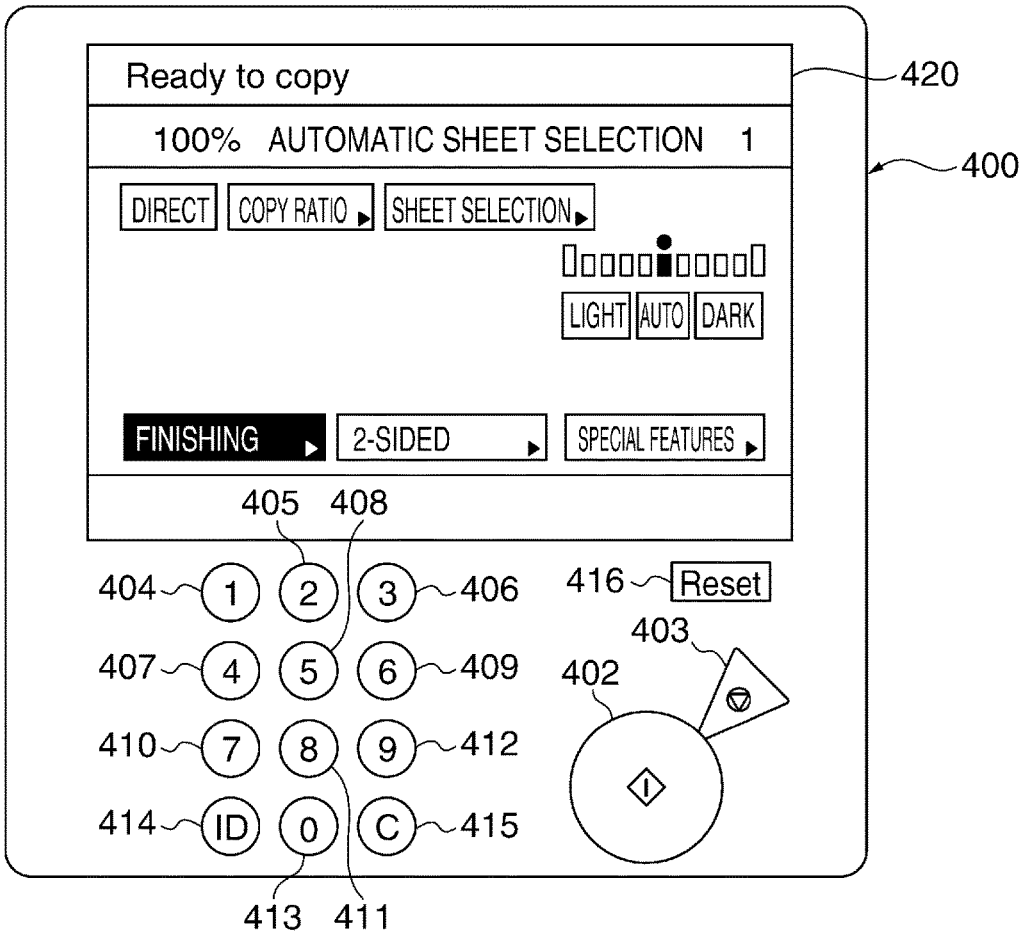
FIG. 4 is a view of a console unit.

FIG. 4 is a view of the console unit 400. On the console unit 400, there are arranged a start key 402 for starting an image forming operation, a stop key 403 for interrupting the image forming operation, a ten-key pad including numeric keys 404 to 413 e.g. for entering numbers, an ID key 414, a clear key 415, a reset key 416, and so forth. Further, the console unit 400 includes the display section 420 having a touch panel provided on the top thereof. Soft keys are arranged on the screen of the display section 420.

The image forming apparatus 10 has a non-sorting mode, a sorting mode, a stapling sorting mode (binding mode), a bookbinding mode, and so forth, as post-processing modes. These processing modes are set or configured by input operations from the console unit 400.

Figure 5:
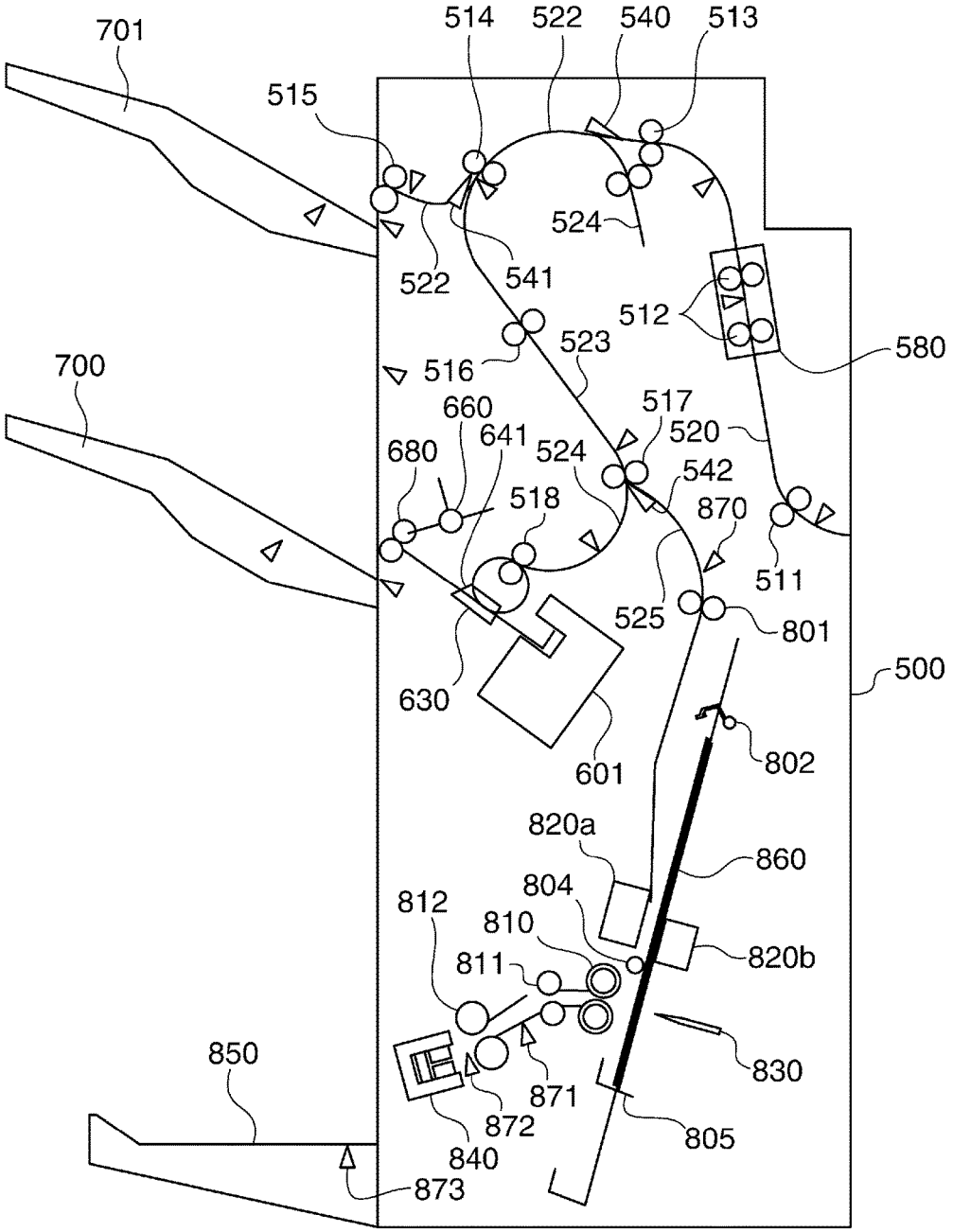
FIG. 5 is a schematic longitudinal cross-sectional view of a finisher.
Figure 7:
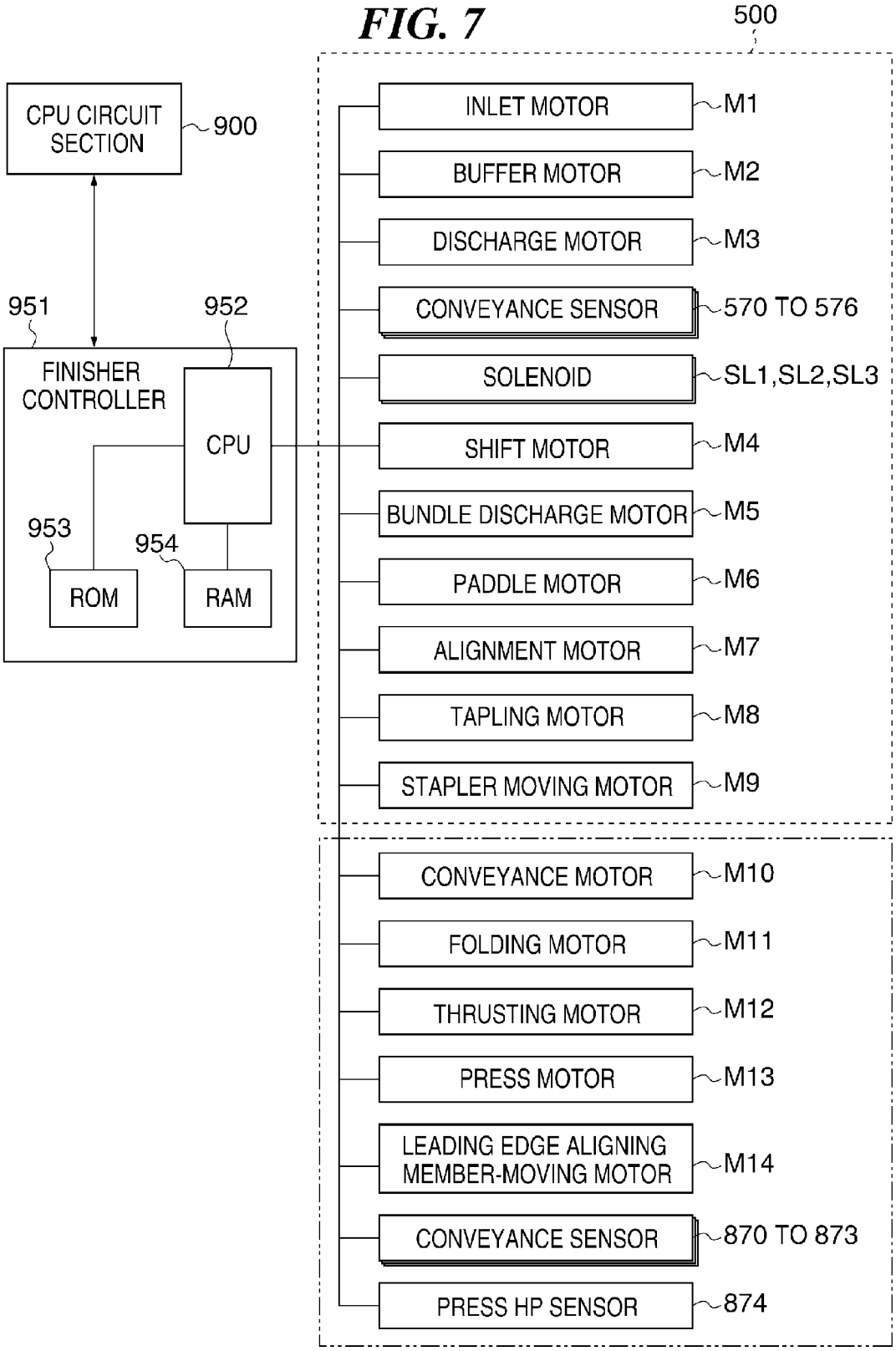
FIG. 7 is a functional block diagram of the finisher.

Next, the arrangement of the finisher 500 will be described with reference to FIGS. 5 and 7. FIG. 5 is a schematic longitudinal cross-sectional view of the finisher 500 appearing in FIG. 1. FIG. 7 is a functional block diagram of the finisher 500.

The finisher 500 is capable of performing processing for sequentially taking in sheets discharged from the image forming apparatus 10, aligning the sheets, and then making a bundle of the sheets, as post-processing. Further, the finisher 500 is capable of performing, as post-processing, stapling processing for stapling the trailing end of the sheet bundle with staples, and bookbinding processing for folding (center-folding) a center portion of the sheet bundle and saddle-stitching the folded portion.

The finisher 500 takes in a sheet discharged from the image forming apparatus 10 into a conveying path 520 by a conveyance roller pair 511. The sheet taken in by the conveyance roller pair 511 is conveyed by conveyance roller pairs 512 and 513.

Between the conveyance roller pair 513 and a conveyance roller pair 514 driven by a buffer motor M2 (see FIG. 7), there is disposed a switching flapper 540 for guiding a sheet which is reversely conveyed by the conveyance roller pair 514 into a lower conveying path 524. Between the conveyance roller pair 514 and a conveyance roller pair 515, there is disposed a switching flapper 541 for switching the sheet conveying path between an upper discharge path 522 and a lower conveying path 523.

When the switching flapper 541 switches the sheet conveying path to the upper discharge path 522, a sheet is guided into the upper discharge path 522 by the conveyance roller pair 514 driven by the buffer motor M2. Then, the sheet is discharged onto a stacking tray 701 by the conveyance roller pair 515 driven by a discharge motor M3 (see FIG. 7).

When the switching flapper 541 switches the sheet conveying path to the lower conveying path 523, a sheet is guided into the lower conveying path 523 by the conveyance roller pair 514 driven by the buffer motor M2 and a conveyance roller pair 516 driven by the discharge motor M3. Then, the sheet is conveyed by a conveyance roller pair 517 driven by the discharge motor M3.

A switching flapper 542 for switching the sheet conveying path between a lower discharge path 524 and a bookbinding path 525 is disposed downstream of the lower conveying path 523. When the switching flapper 542 switches the sheet conveying path to the lower discharge path 524, a sheet is guided to a processing tray 630 by the conveyance roller pair 517 and a conveyance roller pair 518 which are driven by the discharge motor M3, and then is discharged onto a stacking tray 700.

When the switching flapper 542 switches the sheet conveying path to the bookbinding path 525, a sheet is guided into the bookbinding path 525 by the conveyance roller pair 517 driven by the discharge motor M3. The sheet guided into the bookbinding path 525 is conveyed to a bookbinding processing tray 860 as a stacking unit via a conveyance roller pair 801 driven by a conveyance motor M10 (see FIG. 7).

The bookbinding processing tray 860 is provided with a sheet holding member 802, a movable sheet positioning member 804, and a leading edge aligning member 805. Further, an anvil 820*b* is disposed at a location opposed to a stapler 820*a*, and the stapler 820*a* cooperates with the anvil 820*b* to perform stapling processing (saddle-stitching in the present example) of a sheet bundle stacked on the bookbinding processing tray 860.

At respective locations downstream of the stapler 820*a*, there are provided a folding roller pair 810 and a thrusting member 830 as a folding unit. The thrusting member 830 is arranged at a location opposed to the folding roller pair 810. The thrusting member 830 thrusts the sheet bundle stacked on the bookbinding processing tray 860, whereby the sheet bundle is pushed in between the folding roller pair 810, whereby it is folded at the center thereof.

The center-folded sheet bundle is passed to a folding conveyance roller pair 811 and a folding conveyance roller pair 812, which are a conveying unit, via the folding roller pair 810. Between the folding conveyance roller pair 811 and the folding conveyance roller pair 812, there is disposed a conveyance sensor 871. After a fold line portion 831 of the sheet bundle is processed by a press unit 840 as a processing unit, the folding conveyance roller pairs 811 and 812 are operated to discharge the sheet bundle onto a bookbinding tray 850. Between the folding conveyance roller pairs 811 and 812 and the press unit 840, there is disposed a conveyance sensor 872 for detecting a sheet bundle conveyed by the folding conveyance roller pairs 811 and 812. The bookbinding tray 850 is provided with a conveyance sensor 873.

Figure 6A:
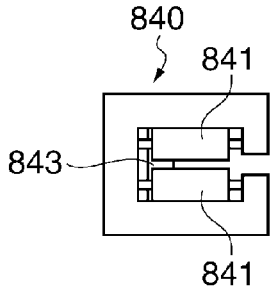
FIG. 6A is a view of a press unit, as viewed from a width direction of a sheet bundle.
Figure 6B:
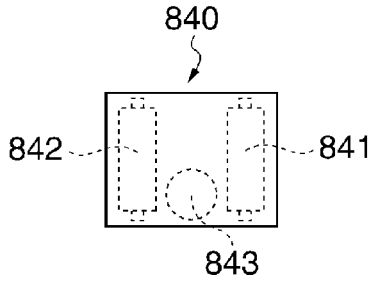
FIG. 6B is a view of the press unit, as viewed from a direction perpendicular to a surface of the sheet bundle (from the above).
Figure 6C:
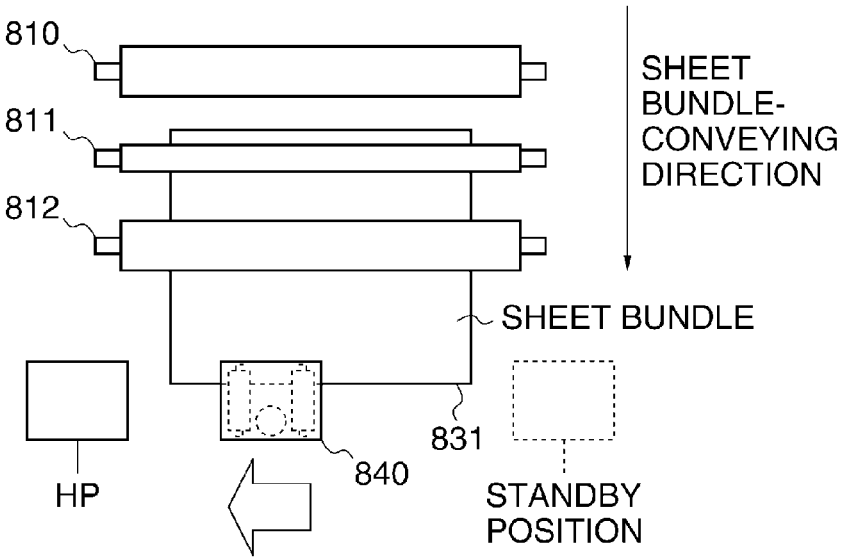
FIG. 6C is a view of an area from a folding roller pair to the press unit, in a state in which pressing of a fold line portion is being performed, as viewed from the direction perpendicular to the surface of the sheet bundle (from the above).
Figure 6D:
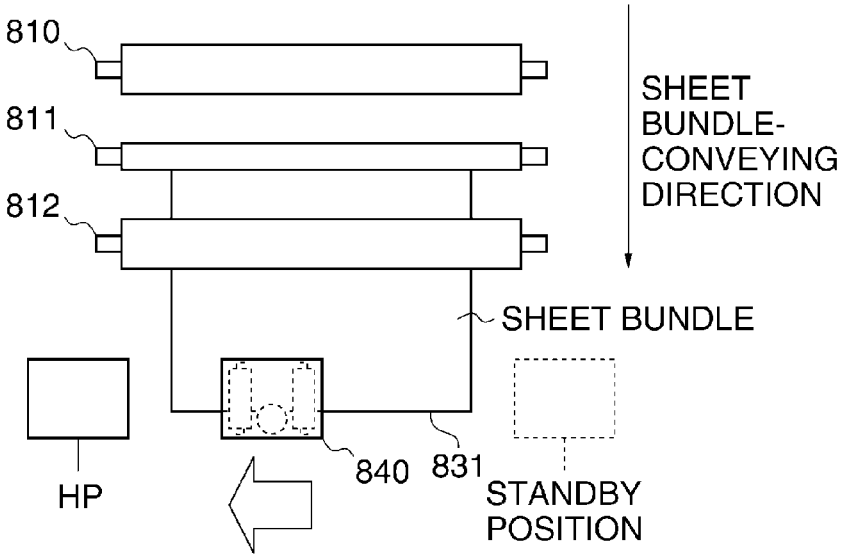
FIG. 6D is a view of the area from the folding roller pair to the press unit, in a state in which flattening of the fold line portion is being performed in parallel with the pressing of the fold line portion, to thereby flatten a back surface of the sheet bundle, as viewed from the direction perpendicular to the surface of the sheet bundle (from the above).

FIG. 6A is a view of the press unit 840, as viewed from the width direction of the sheet bundle. FIG. 6B is a view of the press unit 840, as viewed from a direction perpendicular to a surface of the sheet bundle (from the above). FIGS. 6C and 6D are views of an area from the folding roller pair 810 to the press unit 840, as viewed from the direction perpendicular to the surface of the sheet bundle (from the above).

As shown in FIGS. 6A and 6B, the press unit 840 includes pressing roller pairs 841 and 842 which having respective shaft centers parallel to each other. Further, the press unit 840 includes a saddle pressing roller 843 which has the shaft center orthogonal to the shaft centers of the pressing roller pairs 841 and 842 and is disposed between the pressing roller pairs 841 and 842 in the width direction of the sheet bundle.

The press unit 840 is capable of performing press processing and flattening processing in parallel, as the fold line processing. First, the pressing roller pairs 841 and 842 are pressing members for reinforcing the fold line by pressing the fold line portion 831 of the sheet bundle which has been folded at the center thereof from opposite sides in a direction perpendicular to the front cover surface of the sheet bundle (direction of the thickness). This fold line processing performed by the pressing roller pairs 841 and 842 is referred to as the "press processing". The saddle pressing roller 843 is a pressing member for flattening the fold line portion 831 by pressing the fold line portion 831 of the sheet bundle which has been folded at the center thereof from a direction parallel to the front cover surface of the sheet bundle (direction opposite to the conveying direction and orthogonal to the thickness direction). This fold line processing performed by the saddle pressing roller 843 is referred to as the "flattening processing".

FIG. 6C shows a state where the fold line portion 831 is being pressed, and FIG. 6D shows a state where the fold line portion 831 is being flattened in parallel with pressing of the fold line portion 831 to thereby flatten the back of the sheet bundle.

As shown in FIG. 6C, the press unit 840 is moved from a standby position to a home position (HP), i.e. in the width direction (direction along the fold line portion 831) orthogonal to the direction of conveying the sheet bundle. By this operation, the fold line portion 831 is pressed by the pressing roller pairs 841 and 842 whereby the swelling of the sheet bundle is reduced. At this time, as shown in FIG. 6D, by moving the position of the sheet bundle to the press unit 840 to thereby bring the saddle pressing roller 843 into abutment with the rear portion of the sheet bundle, it is possible to perform processing for flattening the back of the sheet bundle.

The fold line processing for performing both of press processing and flattening processing in parallel so as to reinforce the fold properties of a sheet bundle is particularly referred to as "saddle press", and a processing mode for performing saddle press is referred to as a saddle press mode. The position at which a sheet bundle stops when the fold line processing is performed by the press unit 840 is referred to as a "processing position". The position of the outer peripheral surface of the saddle pressing roller 843 in the conveying direction of the sheet bundle is fixed, and hence if the processing position is changed, an amount of abutment between the saddle pressing roller 843 and the fold line portion 831 is changed whereby a degree of flattening of the fold line portion 843 is changed. As the processing position is at a position more downstream in the conveying direction (as the amount of conveying of the sheet bundle having been center-folded is larger), the amount of abutment is larger, and hence it is possible to expect that the fold line portion is strongly flattened. The user can designate the amount of abutment (pressing strength) between the sheet bundle and the saddle pressing roller 843 to thereby adjust the fold properties of the sheet bundle.

However, as the mount of abutment between the sheet bundle and the saddle pressing roller 843 becomes larger, the operation load of the press unit 840 becomes larger, and if the operation load exceeds the driving force of a press motor M13, the press unit 840 becomes incapable of moving. In this case, although the press motor M13 is not in failure, since the press unit 840 does not move, the press unit 840 does not reach a press home position (HP) sensor 874 within a predetermined time period, which causes an erroneous detection of a failure of the press motor M13. Further, even in a case where the operation load does not exceed the driving force of the press motor M13, if it is close to the driving force, the moving speed of the press unit 840 can become lower or irregular, which sometimes prevents the flattening processing from being properly performed. For this reason, the use of the abutment amount as set by the user is sometimes improper for the flattening processing.

Next, a description will be given, with reference to FIG. 7, of the arrangement of the finisher control controller 951 that drivingly controls the finisher 500, and its control operation.

As shown in FIG. 7, the finisher control controller 951 is comprised of a CPU 952, a ROM 953, and a RAM 954. The finisher control controller 951 communicates with the CPU circuit section 900 provided in the image forming apparatus 10 via a communication IC, not shown, for data exchange, and executes various programs stored in the ROM 953 according to instructions from the CPU circuit section 900 to thereby drivingly control the finisher 500.

The CPU 952 outputs a control signal to an inlet motor M1, the buffer motor M2, the discharge motor M3, a shift motor M4, a bundle discharge motor M5, a paddle motor M6, an alignment motor M7, a stapling motor M8, and a stapler moving motor M9. The inlet motor M1 drives the conveyance roller pairs 511, 512, and 513. The buffer motor M2 drives the conveyance roller pair 514. The discharge motor M3 drives the conveyance roller pairs 515, 516, 517, and 518. The shift motor M4 drives a shift unit 580.

The stapling processing (stitching processing) on the processing tray 630 is performed by a stapler 601. In the stapling processing, a sheet bundle stacked on the processing tray 630 is stapled at the trailing end thereof in the sheet conveying direction. As motors for driving the respective members of the processing tray 630, the bundle discharge motor M5 drives a bundle discharge roller pair 680, the paddle motor M6 drives a paddle 660, the alignment motor M7 drives alignment members 641, and the stapling motor M8 drives the stapler 601. The stapler moving motor M9 moves the stapler 601 along the outer periphery of the processing tray 630 in the direction orthogonal to the sheet conveying direction.

The CPU 952 receives input signals e.g. from conveyance sensors 570 to 576 disposed in the respective conveying paths so as to detect passage of sheets. Further, the CPU 952 outputs a control signal to each of a solenoid SL1 for driving the switching flapper 540, a solenoid SL2 for driving the switching flapper 541, and a solenoid SL3 for driving the switching flapper 542.

The bookbinding processing tray 860, the press unit 840, and so forth, disposed downstream of the bookbinding path 525 form a bookbinding unit having a bookbinding function. For the bookbinding function of the bookbinding unit, the CPU 952 outputs a control signal to each of the conveyance motor M10, a folding motor M11, a thrusting motor M12, the press motor M13, and a leading edge aligning member-moving motor M14.

The conveyance motor M10 drives the conveyance roller pair 801. The folding motor M11 drives the folding roller pair 810, the folding conveyance roller pairs 811 and 812. The thrusting motor M12 drives the thrusting member 830. The press motor M13 drives the press unit 840. The leading edge aligning member-moving motor M14 moves the leading edge aligning member 805. The CPU 952 receives input signals from the conveyance sensors 870 to 873 so as to detect passage of sheets, and receives an input signal from the press home position sensor 874 to detect the home position of the press unit 840.

Next, a description given of a method of configuring the bookbinding mode on the console unit 400 of the image forming apparatus 10 with reference to FIGS. 8A to 8E. FIGS. 8A to 8E are diagrams showing examples of screens displayed by being shifted therebetween when a bookbinding mode is configured on the console unit 400.

The bookbinding mode is configured by a user from the display section 420 of the console unit 400. When the user depresses an "special features" key on an initial screen (see FIG. 8A) displayed on the display section 420, the screen is shifted to a special features selection screen (see FIG. 8B) by the CPU 901.

When the user depresses a "bookbinding" key on the special features selection screen, the screen is shifted to a sheet feeder selection screen (see FIG. 8C) by the CPU 901. On the other hand, when the user depresses a "close" key on the special features selection screen, the screen is shifted to the initial screen (see FIG. 8A) by the CPU 901.

After the user has selected a sheet feeder on the sheet feeder selection screen (see FIG. 8C), when the user depresses a "next" key, the screen is shifted to a saddle stitching-setting screen (see FIG. 8D) by the CPU 901. On the other hand, when the user depresses a "return" key on the sheet feeder selection screen, the screen is shifted to the special features selection screen (see FIG. 8B) by the CPU 901.

On the saddle stitching-setting screen (see FIG. 8D), the user selects whether or not to perform saddle stitching and whether or not to perform saddle press. First, when saddle stitching is to be performed, the user selects a "perform saddle stitching" key. When saddle stitching is not to be performed, the user is only required to depress a "do not perform saddle stitching" key. After the user has selected one of the "perform saddle stitching" key and the "do not perform saddle stitching" key on the saddle stitching-setting screen, when the user depresses an "OK" key, the bookbinding mode configuration is completed.

When the user depresses a "return" key on the saddle stitching-setting screen, the screen is shifted to the sheet feeder selection screen (see FIG. 8C) by the CPU 901. In a state where the "perform saddle stitching" key has been selected, when the user depresses a "saddle press" key 421 and depresses the "OK", the screen is shifted to a saddle press-setting screen (see FIG. 8E) by the CPU 901.

When an "OK" key is selected on the saddle press-setting screen, the CPU 901 sets the item of "saddle press" of the sheet information J1 (see FIG. 2A) to "SET", whereas when a "setting cancel" key is selected, the CPU 901 sets the item of "saddle press" of the sheet information J1 to "NOT SET". The setting of "SET" means that the saddle press mode is set. The user can increase or reduce a pressure adjustment value P1 for adjusting the strength of saddle press, i.e. the pressing strength by using a "+" or "−" key on the saddle press-setting screen before depressing the "OK" key. When the saddle press-setting screen is initially displayed, the pressure adjustment value P1 is set to a default value, and is increased or reduced whenever the "+" or "−" key is depressed. The value having been input when the "OK" key is depressed is set as the pressure adjustment value P1 in the sheet information J1.

Figure 8A:
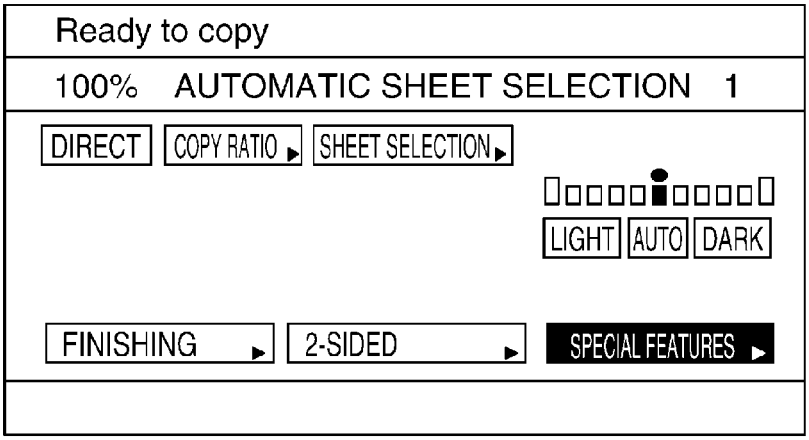
FIG. 8A is a diagram showing an initial screen displayed on a display section when a bookbinding mode is configured on the console unit.
Figure 8B:
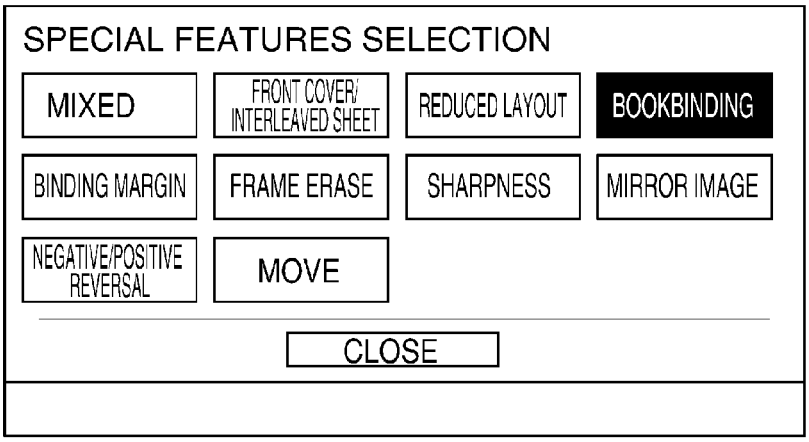
FIG. 8B is a diagram showing a special features selection screen displayed on the display section when the bookbinding mode is configured.
Figure 8C:
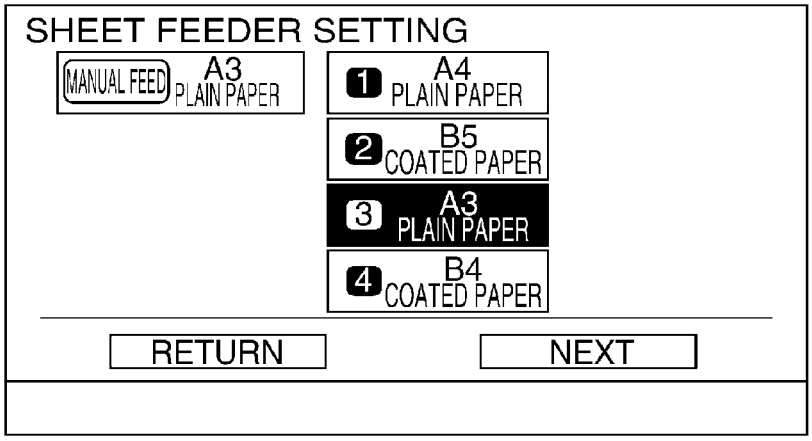
FIG. 8C is a diagram showing a sheet feeder selection screen displayed on the display section when the bookbinding mode is configured.
Figure 8D:
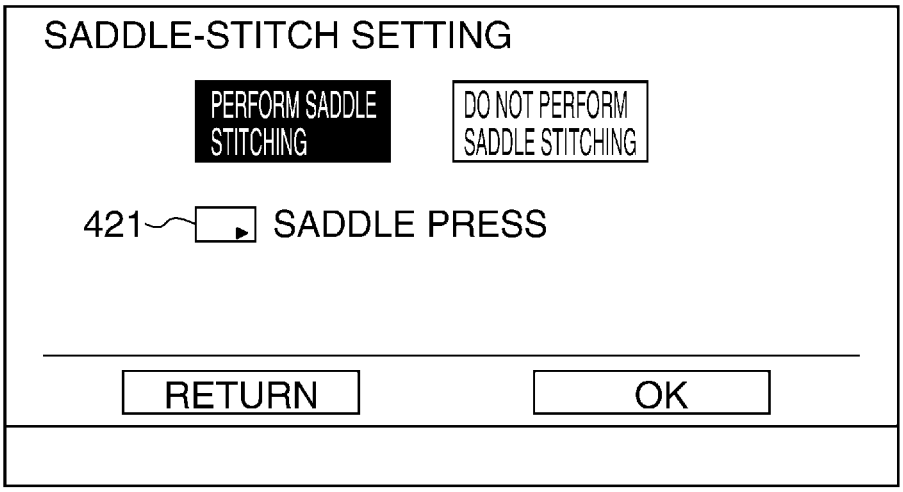
FIG. 8D is a diagram showing a saddle stitching-setting screen displayed on the display section when the bookbinding mode is configured.
Figure 8E:
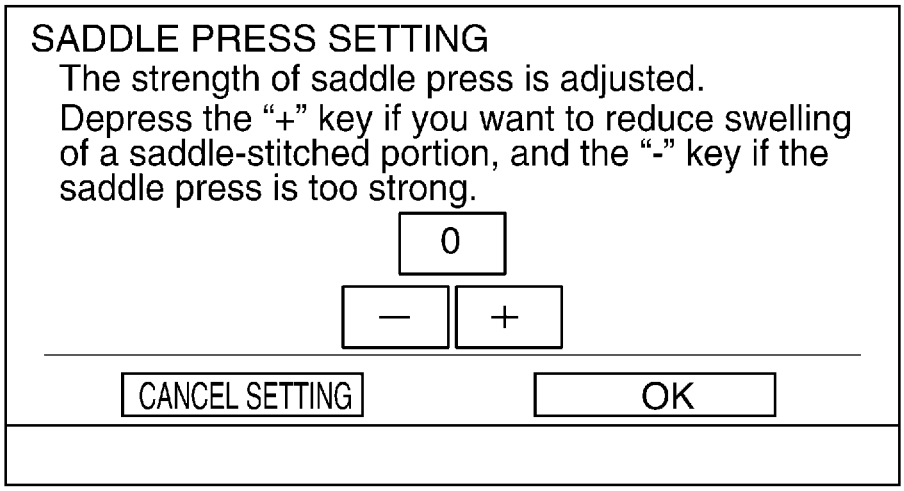
FIG. 8E is a diagram showing a saddle press-setting screen displayed on the display section when the bookbinding mode is configured.

It is assumed here, by way of example, that a sheet feeder in which A-3 sheets of plain paper (80 g/m$^2$) are set is selected on the sheet feeder selection screen (see FIG. 8C), and "perform saddle stitching" and "saddle press" are selected on the saddle stitching-setting screen (see FIG. 8D). Further, it is assumed that a value of 5 is input as the pressure adjustment value P1, and the "OK" key is depressed on the saddle press-setting screen (see FIG. 8E). As a consequence, in the sheet information J1 (see FIG. 2), the sheet length, the sheet width, the basis weight, the sheet type, the post-processing mode, the saddle press, and the pressure adjustment value P1 are set to values of 420 mm, 297 mm, 80 g/m$^2$, plain paper, saddle stitching, "SET", and 5 pls, respectively. By performing a pressure adjustment distance-setting process in FIG. 12, described hereinafter, the stop position, i.e. the processing position of the sheet bundle for flattening processing is adjusted by 0.5 mm per 1 pls value of the pressure adjustment value P1.

When the bookbinding mode configuration is completed and the user depresses the start key 402 (see FIG. 4), a bookbinding process is started.

Next, a description will be given of the bookbinding process in the bookbinding mode, which is performed by the finisher 500, with reference to FIGS. 9 to 11E.

The bookbinding process is a process including center-folding, and is performed when the user inputs a job to which the sheet size and the number of copies to be processed are set. The number of sheets (number of sheets of a bundle) per one copy (per product unit) of the designated number of copies to be processed is determined by the number of originals set on the document tray 101 when the job is input.

Figure 9:
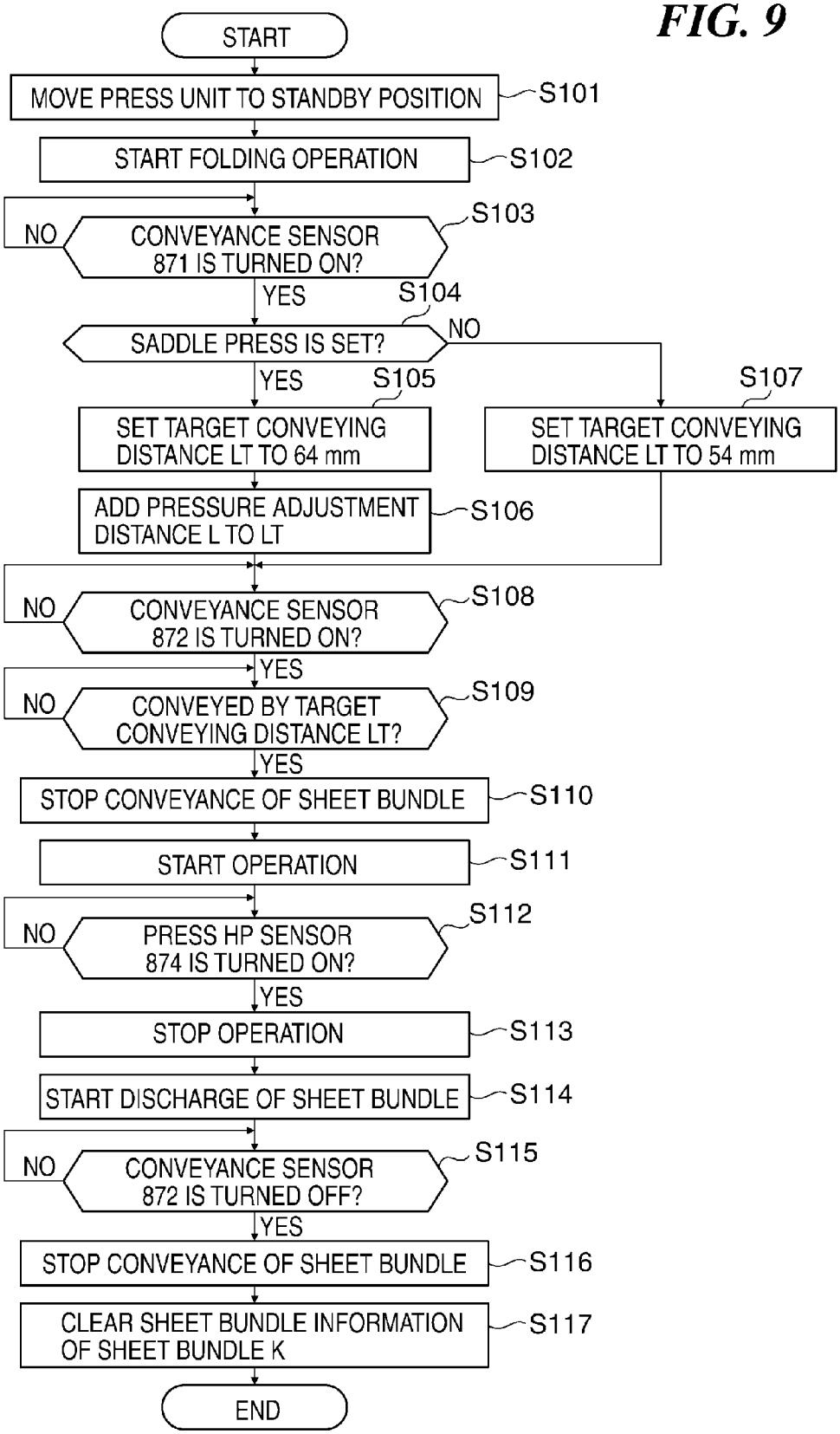
FIG. 9 is a flowchart of a bookbinding process performed in the bookbinding mode.

FIG. 9 is a flowchart of the bookbinding process in the bookbinding mode, which is performed by the finisher 500. FIG. 9 shows the bookbinding process in the bookbinding mode performed on a K-th sheet bundle (here referred to as the "sheet bundle K") out of the copies to be processed.

FIG. 10 is a diagram showing a format of sheet bundle information. This sheet bundle information, denoted by reference numeral J2, is generated by the CPU 952 based on the sheet information J1 (see FIG. 2) notified from the image forming apparatus 10 and information generated in the pressure adjustment distance-setting process in FIG. 12, described hereinafter, and is stored in the RAM 954. The sheet bundle information J2 includes a bundle ID, the number of sheets of a bundle, a sheet width, a sheet length, a basis weight, a sheet type, saddle press (SET or NOT SET), a pressure adjustment value P1, and a pressure adjustment distance L.

Figure 12:
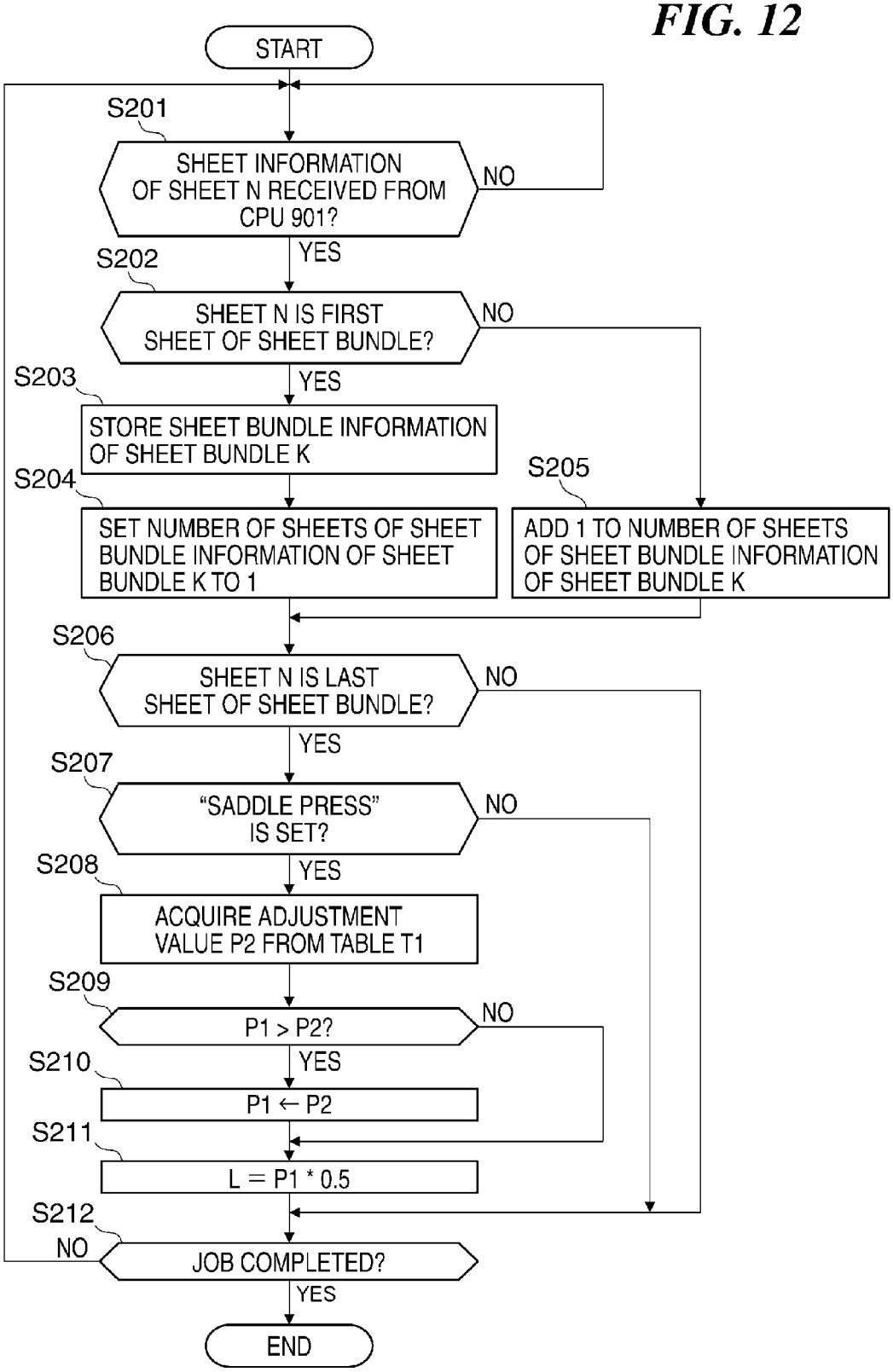
FIG. 12 is a flowchart of a pressure adjustment distance-setting process.

Out of these, the sheet length, the sheet width, the basis weight, the sheet type, and the saddle press are set based on the contents of the notified sheet information J1. The bundle ID is set when the sheet bundle information J2 is generated. The number of sheets of a bundle is set by the pressure adjustment distance-setting process (FIG. 12), described hereinafter. The pressure adjustment value P1 is set based on the pressure adjustment value P1 included in the notified sheet information J1, but can be updated by the pressure adjustment distance-setting process (FIG. 12). The pressure adjustment distance L is set by calculation based on a comparison between the pressure adjustment value P1 and an upper limit pressure adjustment value P2 (described hereinafter) in the pressure adjustment distance-setting process (FIG. 12).

The bookbinding process in the bookbinding mode in FIG. 9 is started when all sheets forming the sheet bundle K have been stacked on the bookbinding processing tray 860. First, in a step S101, the CPU 952 causes the press unit 840 to move to the standby position, and starts a folding operation in a step S102. More specifically, the CPU 952 drives the folding motor M11 to rotate the folding roller pair 810, and drives the thrusting motor M12 to control the thrusting member 830 to thrust the sheet bundle stacked on the bookbinding processing tray 860.

Figure 11A:
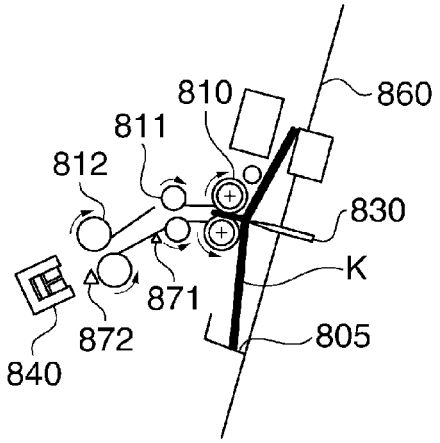
FIGS. 11A to 11E are transition diagrams illustrating a bookbinding operation.

FIGS. 11A to 11E shows transition in the bookbinding operation. As shown in FIG. 11A, the sheet bundle K stacked on the bookbinding processing tray 860 is pushed out toward the folding roller pair 810, and is folded at the center thereof by the folding roller pair 810. Then, the folding conveyance roller pairs 811 and 812 convey the sheet bundle K downstream (in a direction toward the press unit 840).

Next, in a step S103, the CPU 952 waits until the conveyance sensor 871 is turned on, and when the conveyance sensor 871 is turned on, the CPU 952 judges that the sheet bundle has reached the conveyance sensor 871, and proceeds to a step S104. In the step S104, the CPU 952 refers to the saddle press in the sheet bundle information J2 stored in the RAM 954, and determines whether or not the saddle press is "SET". If it is determined in the step S104 that the saddle press is "SET", the CPU 952 proceeds to a step S105, whereas if the saddle press is "NOT SET", the CPU 952 proceeds to a step S107.

In the step S107, the CPU 952 sets a target conveying distance LT to 54 mm, which is a distance over which the sheet bundle K is to be conveyed from a "predetermined position", and proceeds to a step S108. The predetermined position is a position in the direction of conveying the sheet bundle K at which the conveyance sensor 872 is disposed, and more strictly, it is a position at which the conveyance sensor 872 is turned on by the center-folded sheet bundle K being conveyed. A position reached by the sheet bundle K when conveyed over the target conveying distance LT from the predetermined position is the above-mentioned processing position at which the fold line processing by the press unit 840 is performed. Although the value of 54 mm is an example of the fixed value set in a mode in which only press processing is performed without performing flattening processing, this fixed value is not limited to the value of the illustrated example.

In the step S105, the CPU 952 sets the target conveying distance LT to 64 mm. Although the value of 64 mm is an example of the initial value set in a case where flattening processing and press processing are both performed, this initial value is not limited to the value of the illustrated example. However, the initial value is set to a value larger than the value (54 mm) set in the step S107. This is because in a case where the saddle press is "SET", it is necessary to convey the sheet bundle K over a longer distance than in a case where the saddle press is "NOT SET" so as to bring the fold line portion 831 of the sheet bundle K into abutment with the saddle pressing roller 843.

In a step S106, the CPU 952 updates the target conveying distance LT by adding the pressure adjustment distance L included in the sheet bundle information J2 stored in the RAM 954, to the target conveying distance LT (64 mm in the present example) (LT←64+L mm). The target conveying distance LT is set in the step S106 or S107, whereby the processing position in fold line processing performed by the press unit 840 is determined. That is, the CPU 952 corresponds to a determination unit in the present invention.

Next, the CPU 952 waits until the conveyance sensor 872 is turned on in the step S108, and when the conveyance sensor 872 is turned on, the CPU 952 judges that the sheet bundle K has reached the position of the conveyance sensor 872 (predetermined position), and proceeds to a step S109. The sheet bundle K is conveyed by the folding conveyance roller pairs 811 and 812, with the fold line portion 831 as a leading edge. In the step S109, the CPU 952 waits until the sheet bundle K is conveyed by the target conveying distance LT set in the step S106 or S107 after the conveyance sensor 872 is turned on. Then, when the sheet bundle K has been conveyed over the target conveying distance LT, the CPU 952 proceeds to a step S110.

Figure 11B:
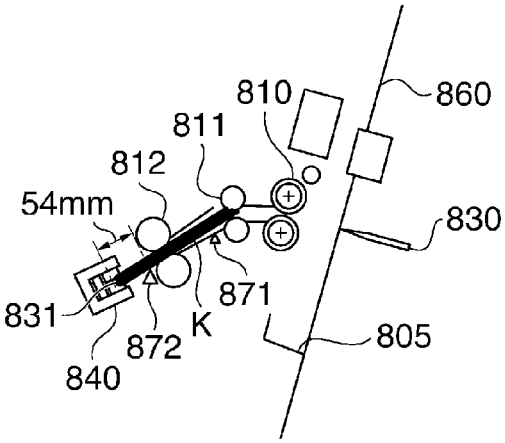
Figure 11C:
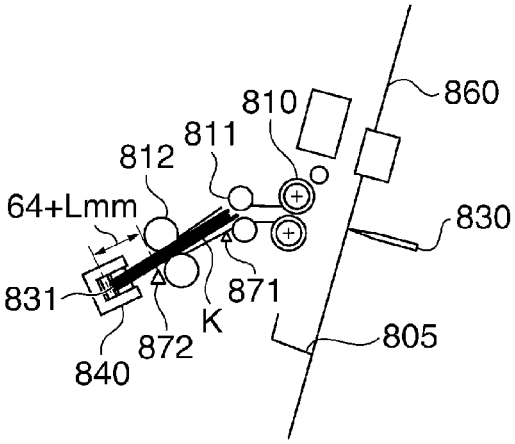

In the step S110, the CPU 952 stops the folding motor M11 to stop conveyance of the sheet bundle K by the folding conveyance roller pairs 811 and 812. FIGS. 11B and 11C show a state where the sheet bundle K has been conveyed over the distance of 54 mm and stopped and a state where the sheet bundle K has been conveyed by the distance of 64+L mm and stopped, respectively. Each position where the sheet bundle K is stopped is the processing position.

Figure 11D:
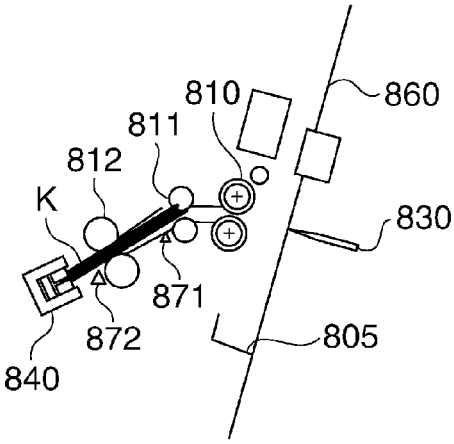
Figure 11E:
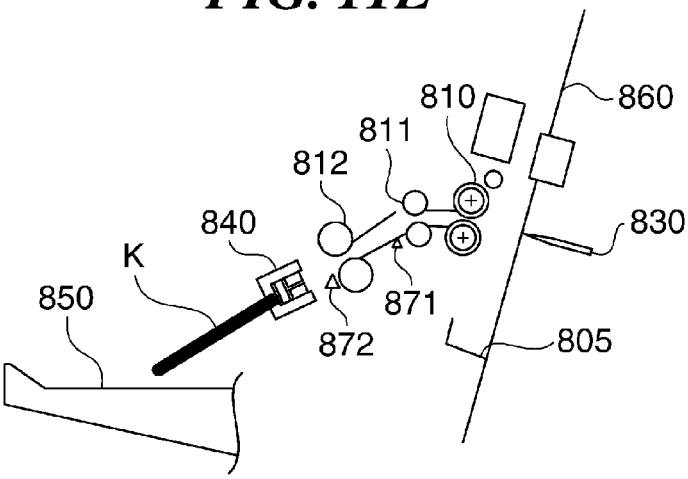

In a step S111, the CPU 952 drives the press motor M13 to move the press unit 840, and thereby starts the operation of fold line processing on the sheet bundle K (see FIG. 11D). At this time, in a case where the processing position is a position where the sheet bundle K has been conveyed from the predetermined position over 64+L mm (see FIG. 11C), the flattening operation by the saddle pressing roller 843 acts on the fold line portion 831, whereby flattening processing is also performed.

Next, in a step S112, the CPU 952 waits until the press home position sensor 874 is turned on. When the press home position sensor 874 is turned on, the CPU 952 can judge that the fold line processing performed by the press unit 840 on the sheet bundle K is completed, and hence the CPU 952 stops the press motor M13 (step S113). Thus, the operation of fold line processing is stopped. In a step S114, the CPU 952 drives the folding motor M11 to start discharge of the sheet bundle K by the folding conveyance roller pairs 811 and 812.

Next, in a step S115, the CPU 952 waits until the conveyance sensor 872 is turned off, and when the conveyance sensor 872 is turned off, the CPU 952 stops the folding motor M11 to thereby stop conveyance of the sheet bundle K (step S116). Thus, discharge of the sheet bundle K by the folding conveyance roller pairs 811 and 812 is completed (see FIG. 11E). After that, in a step S117, the CPU 952 clears the sheet bundle information J2 of the sheet bundle K stored in the RAM 954, and terminates the bookbinding operation.

Next, a description will be given of the pressure adjustment distance-setting process in which the CPU 952 of the finisher 500 sets the pressure adjustment distance L based on the contents of the sheet information J1 received from the CPU 901 of the image forming apparatus 10 with reference to FIGS. 12 and 13.

FIG. 12 is a flowchart of the pressure adjustment distance-setting process. This process is started by inputting of a job. In this process, a sheet which has reached the registration roller pair 126 is referred to as the "sheet N". First, the CPU 952 waits until the sheet information J1 of the sheet N is received from the CPU 901 (step S201), and when the sheet information J1 is received, the CPU 952 stores the received sheet information J1 in the RAM 954, and proceeds to a step S202.

Next, in the step S202, the CPU 952 determines whether or not the sheet N is the first sheet of the sheet bundle K including the sheet N, i.e. whether or not the sheet N is the first sheet of a "copy" which is a product unit. If it is determined in the step S202 that the sheet N is the first sheet, the CPU 952 proceeds to a step S203, whereas if not, the CPU 952 proceeds to a step S205.

In the step S203, the CPU 952 overwrites corresponding items of the sheet bundle information J2 of the sheet bundle K, which is stored in the RAM 954 with the sheet width, with the sheet length, the basis weight, the sheet type, the saddle press (SET or NOT SET), and the pressure adjustment value P1 of the sheet information J1 of the sheet N, which is stored in the step S201. The pressure adjustment value P1 is a first pressing strength designated in the image forming apparatus 10 as the pressing strength to be applied to flattening processing. The CPU 952 corresponds to a first acquisition unit of the present invention. Then, in a step S204, the CPU 952 sets the number of sheets of a bundle in the sheet bundle information J2 of the sheet bundle K to 1 and proceeds to a step S206. In the step S205, the CPU 952 adds 1 to the number of sheets of the bundle in the sheet bundle information J2 of the sheet bundle K and proceeds to the step S206.

In the step S206, the CPU 952 determines whether or not the sheet N is the last sheet of the sheet bundle K including the sheet N, i.e. whether or not the sheet N is the last sheet of a "copy" which is a product unit. If it is determined in the step S206 that the sheet N is the last sheet, the CPU 952 proceeds to a step S207, whereas if not, the CPU 952 proceeds to a step S212.

In the step S207, the CPU 952 determines whether or not the saddle press in the sheet bundle information J2 is "SET". If it is determined in the step S207 that the saddle press is "SET", since the processing mode is the saddle press mode, the CPU 952 performs processing for calculating the pressure adjustment distance L for use in executing the saddle press in steps S208 to S211. On the other hand, if the saddle press is "NOT SET", the CPU 952 proceeds to the step S212. This is because since flattening processing is not performed, it is unnecessary to determine the pressure adjustment distance L.

In the step S208, the CPU 952 acquires the upper limit pressure adjustment value P2 which is an adjustable upper limit value, based on the sheet bundle information J2 and a table T1 shown in FIG. 13. The upper limit pressure adjustment value P2 is a second pressing strength acquired from the "information on the sheet bundle" acquired as described above. That is, the CPU 952 corresponds to a second acquisition unit of the present invention.

FIG. 13 is a diagram showing an example of the table for use in setting the upper limit pressure adjustment value P2. The table T1 is created and stored in the ROM 953 or the like in advance. The table T1 defines the upper limit pressure adjustment value P2 for each combination of a sheet type (plain paper or coated paper) and the basis weight of a sheet, and the number of sheets of a sheet bundle. Note that the acquisition of the upper limit pressure adjustment value P2 from the table T1 is not limitative, but the upper limit pressure adjustment value P2 may be calculated by using an equation based on at least one of the sheet size, the sheet type, the number of sheets of a bundle, and the basis weight. The upper limit pressure adjustment value P2 is set to a value at which the operation load of the press unit 840 is equal to the driving force of the press motor M13 during the operation of fold line processing on the sheet bundle K, or a value at which the operation load is smaller than the driving force by an amount which takes into account a safety factor.

In the step S209, the CPU 952 compares the pressure adjustment value P1 (first pressing strength) in the sheet bundle information J2 and the upper limit pressure adjustment value P2 (second pressing strength) acquired in the step S208. Then, the CPU 952 determines whether or not the pressure adjustment value P1 is larger than the upper limit pressure adjustment value P2 (P1>P2 holds). If it is determined in the step S209 that P1>P2 holds, the use of the pressure adjustment value P1 as it is can cause an inconvenience that the operation load of the press unit 840 exceeds the driving force of the press motor M13 during the operation of fold line processing on the sheet bundle K. To prevent this, in the step S210, the CPU 952 updates the pressure adjustment value P1 by overwriting the value thereof with the value of the upper limit pressure adjustment value P2 (P1←P2). This causes the upper limit pressure adjustment value P2 to be practically selected for use as the pressure adjustment value. Then, the CPU 952 proceeds to the step S211.

On the other hand, if P1>P2 does not hold (P1≤P2), the use of the pressure adjustment value P1 as it is cannot cause the inconvenience that the operation load of the press unit 840 exceeds the driving force of the press motor M13 during the operation of fold line processing on the sheet bundle K, and hence the CPU 952 proceeds to the step S211 without updating the pressure adjustment value P1. In this case, the pressure adjustment value P1 is selected for use.

In the step S211, the CPU 952 converts the pressure adjustment value P1 in the sheet bundle information J2 of the sheet bundle K to the pressure adjustment distance L. The folding conveyance roller pairs 811 and 812 convey the sheet bundle by 0.5 mm whenever the folding motor M11 drives the folding conveyance roller pairs 811 and 812 by 1 pls. Therefore, the CPU 952 sets a value obtained by multiplying the pressure adjustment value P1 by 0.5 as the pressure adjustment distance L (L=P1×0.5), and stores the calculated pressure adjustment distance L in the sheet bundle information J2 of the sheet bundle K. The pressure adjustment distance L stored in this step is reflected on the setting of the target conveying distance LT in the step S106 of the above-described bookbinding process in the bookbinding mode in FIG. 9.

Next, in the step S212, the CPU 952 determines whether or not the job is completed, and if the job is not completed, the CPU 952 returns to the step S201, and shifts to processing on the next sheet. On the other hand, if the job is completed, the CPU 952 terminates the pressure adjustment distance-setting process in FIG. 12.

For example, assuming that the sheet bundle K is to be formed of twenty A3-sized sheets of plain paper, each having a basis weight of 80 g/m$^2$, and the pressure adjustment value P1 is set to 5 pls, the upper limit pressure adjustment value P2 acquired in the step S208 is 8 pls (see FIG. 13). Therefore, the process flows from the step S209 directly to the step S211, whereby the pressure adjustment value P1 input by the user is made valid and adopted as it is.

Further, assuming that the sheet bundle K is formed of twenty A3-sized sheets of plain paper, each having a basis weight of 80 g/m$^2$, and the pressure adjustment value P1 is set to 10 pls, the upper limit pressure adjustment value P2 acquired in the step S208 is 8 pls (see FIG. 13). Therefore, the process flows from the step S209 via the step S210 to the step S211, whereby not the pressure adjustment value P1 input by the user, but the acquired upper limit pressure adjustment value P2 is made valid and adopted.

Therefore, in the saddle press mode, even when sheet bundles have the same number of sheets, sheet width, sheet length, basis weight, and sheet type, whether or not to execute the step S210 is different on a sheet bundle-by-sheet bundle basis depending on the pressure adjustment value P1 input by the user.

As described above, in the saddle press mode, the pressure adjustment distance L is calculated by conversion of the pressure adjustment value P1, based on the "information on the sheet bundle" (the sheet size (sheet width and length), the number of sheets of a bundle, the sheet type, and the basis weight, in the sheet bundle information J2), and the target conveying distance LT is set from the pressure adjustment distance L. Then, a position shifted downstream from the predetermined position by the target conveying distance LT is determined as the processing position.

Note that in the step S106 of the bookbinding process in the bookbinding mode in FIG. 9, the target conveying distance LT is consequently set by adding thereto the pressure adjustment distance L converted from one of the pressure adjustment value P1 and the upper limit pressure adjustment value P2 which is not larger than the other. The value of the target conveying distance LT set in the step S107 is smaller than the value of the target conveying distance LT set in the step S106. Therefore, in any case, the target conveying distance LT never exceeds the range of distance determined based on the information on the sheet bundle (64 mm+P2×0.5), and is set within this range.

According to the present embodiment, the processing position is determined based on the information on a sheet bundle before execution of flattening processing, and hence it is possible to properly perform the fold line processing at a position dependent on the sheet bundle. Particularly, the target conveying distance LT is set based on one of the pressure adjustment value P1 and the upper limit pressure adjustment value P2 each defining a pressing strength, which one is not larger than the other. Therefore, regardless of the magnitude of the pressure adjustment value P1 set by the user, the operation load of the press unit 840 never exceeds the driving force of the press motor M13 during the operation of fold line processing. As a consequence, the press unit 840 properly moves along the fold line portion 831 whereby the proper processing is performed. Further, it is also possible to prevent erroneous detection of a failure of the press motor M13.

Incidentally, in the saddle press mode, although the present embodiment has been described assuming that the user can set the pressure adjustment value P1 to a desired value in the sheet information J1, the pressure adjustment value P1 may be a fixed value. Also in this case, the target conveying distance LT is set by adding thereto the pressure adjustment distance L converted from the one of the pressure adjustment value P1 and the upper limit pressure adjustment value P2 which is not larger than the other. If the pressure adjustment value P1 is a sufficiently large fixed value, the upper limit pressure adjustment value P2 is always smaller than the pressure adjustment value P1. Therefore, as a result, the target conveying distance LT is set based only on the upper limit pressure adjustment value P2. Since the upper limit pressure adjustment value P2 is determined based on the "information on the sheet bundle" (the sheet size, the number of sheets of a bundle, the sheet type, and the basis weight) by consulting the table T1, the target conveying distance LT is practically set based on the "information on the sheet bundle".

Note that the "information on the sheet bundle" used as a basis for setting the target conveying distance LT is only required to be at least one of the sheet size, the number of sheets of a bundle, the sheet type, and the basis weight, in the sheet bundle information J2. Further, any other information may be included in the "information on the sheet bundle" insofar as it is a parameter related to the operation load of the press unit 840.

Note that the sheet processing apparatus to which the present invention is applied may be an apparatus referred to as the image forming apparatus or the like, which has the image forming function.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-234560 filed Nov. 19, 2014, which is hereby incorporated by reference herein in its entirety.

What is claimed is:

1. A sheet processing apparatus comprising:

a stacking unit configured to have sheets stacked thereon, which are sequentially received from an image forming apparatus, as a sheet bundle;

a folding unit configured to fold the sheet bundle stacked on the stacking unit at the center of the sheet bundle in a conveying direction of the sheets;

a conveying unit configured to convey the sheet bundle folded at the center by the folding unit to a processing position;

a press unit configured to move along a fold line portion of the sheet bundle conveyed to the processing position by the conveying unit, while pressing the fold line portion from a direction orthogonal to a thickness direction of the sheet bundle in a first mode, to flatten the fold line portion;

a first acquisition unit configured to acquire a first pressing strength, which is applied to the fold line portion at a time of flattening the fold line portion, designated by a user;

a second acquisition unit configured to acquire information on the sheet bundle to be processed by the press unit, and acquire a second pressing strength based on the acquired information; and a determination unit configured to determine a pressing strength to be actually applied to the fold line portion, based on the first pressing strength acquired by the first acquisition unit and the second pressing strength acquired by the second acquisition unit before the press unit flattens the fold line portion.

2. The sheet processing apparatus according to claim 1, wherein the determination unit determines the pressing strength to be actually applied to the fold line portion based on one of the first pressing strength or the second pressing strength, which is not larger than the other.

3. The sheet processing apparatus according to claim 1, wherein:

the pressing strength to be actually applied to the fold line of the sheet bundle varies according to the processing position, the determination unit determines a stop position of the folded sheet bundle conveyed by the conveying unit according to the determined pressing strength, and the press unit flattens the fold line portion with the determined stop position as the processing position.

4. The sheet processing apparatus according to claim 3, wherein the determination unit determines a stop position of the folded sheet bundle based on the one pressing strength, which is not larger than the other.

5. The sheet processing apparatus according to claim 4, wherein:

the press unit is further configured to move along the fold line portion of the sheet bundle, while pressing the fold line portion from the thickness direction, to reinforce the fold line portion, wherein in the first mode, the press unit flattens and reinforces the fold line portion in parallel, wherein in a second mode the press unit reinforces the fold line portion without flattening the fold line portion, and wherein the determination unit determines the stop position by comparing the first pressing strength and the second pressing strength with each other in the first mode, and determines the stop position as a fixed position regardless of the first pressing strength and the second pressing strength in the second mode.

6. The sheet processing apparatus according to claim 5, wherein:

the press unit includes a first roller for pressing the fold line portion from the direction orthogonal to the thickness direction, and a second roller for pressing the fold line portion from opposite sides of the sheet bundle in the thickness direction, and the first roller and the second roller move as one along the fold line portion.

7. The sheet processing apparatus according to claim 1, wherein the first pressing strength is settable by the user via a console unit of the image forming apparatus.

8. The sheet processing apparatus according to claim 1, wherein the information on the sheet bundle includes at least one of the number of sheets, a sheet size, a sheet type, or a basis weight of sheets forming the sheet bundle.

9. The sheet processing apparatus according to claim 1, wherein the second pressing strength is an upper limit value of the pressing strength that is determined in advance according to information on the sheet bundle.

10. An image forming system comprising:

an image forming apparatus configured to form an image on a sheet;

a stacking unit configured to have sheets stacked thereon, which are sequentially received from the image forming apparatus, as a sheet bundle;

a folding unit configured to fold the sheet bundle stacked on the stacking unit at the center of the sheet bundle in a conveying direction of the sheets;

a conveying unit configured to convey the sheet bundle folded at the center by the folding unit to a processing position;

a press unit configured to move along a fold line portion of the sheet bundle conveyed to the processing position by the conveying unit, while pressing the fold line portion from a direction orthogonal to a thickness direction of the sheet bundle, to flatten the fold line portion;

a first acquisition unit configured to acquire a first pressing strength, which is applied to the fold line portion at a time of flattening the fold line portion designated by a user;

a second acquisition unit configured to acquire information on the sheet bundle to be processed by the press unit, and acquire a second pressing strength based on the acquired information; and a determination unit configured to determine a pressing strength to be actually applied to the fold line portion based on the first pressing strength acquired the first acquisition unit and the second pressing strength acquired by the second acquisition unit before the press unit flattens the fold line portion.

* * * * *